US009650170B2

(12) United States Patent
Oostwouder

(10) Patent No.: US 9,650,170 B2
(45) Date of Patent: May 16, 2017

(54) CONTAINER WITH ARCUATE SIDEWALL PANELS

(71) Applicant: COLGATE-PALMOLIVE COMPANY, New York, NY (US)

(72) Inventor: Theodoor C. Oostwouder, Paris (FR)

(73) Assignee: COLGATE-PALMOLIVE COMPANY, New York, NY (US)

( * ) Notice: Subject to any disclaimer, the term of this patent is extended or adjusted under 35 U.S.C. 154(b) by 0 days.

(21) Appl. No.: 14/797,327

(22) Filed: Jul. 13, 2015

(65) Prior Publication Data

US 2016/0167822 A1 Jun. 16, 2016

Related U.S. Application Data

(60) Provisional application No. 62/089,918, filed on Dec. 10, 2014.

(51) Int. Cl.
*B65D 1/02* (2006.01)
*B65D 1/42* (2006.01)
(Continued)

(52) U.S. Cl.
CPC ..... *B65D 1/0223* (2013.01); *B65D 1/40* (2013.01); *B65D 23/0871* (2013.01);
(Continued)

(58) Field of Classification Search
CPC ..... B29C 45/1703; B29C 45/1704; B29C 45/2612; B29C 45/372; B29C 45/374;
(Continued)

(56) References Cited

U.S. PATENT DOCUMENTS 1,636,174 A * 7/1927 Dolan ..... B65D 23/102 215/384
3,325,031 A * 6/1967 Singier ..... A61J 1/05 215/232
(Continued)

FOREIGN PATENT DOCUMENTS

CA 1164370 3/1984
DE 102009038608 3/2011
(Continued)

OTHER PUBLICATIONS

Corresponding International Search Report and Written Opinion for PCT/US2015/064393 dated Feb. 11 , 2016.

*Primary Examiner* — J. Gregory Pickett
*Assistant Examiner* — Niki M Eloshway

(57) ABSTRACT

A container including one or more recessed or raised sidewall panels that increase compressive load resistance, for example top load resistance and/or side load resistance. The container can further include a first end having a base, a second end having an opening therein, wherein the first end is opposite the second end and the base is opposite the opening, a sidewall that extends between the first end and the second end, and an axis that extends perpendicular to the base from the first end to the second end. The one or more sidewall panels have an arcing profile that extends along a direction parallel with the axis. The one or more arcing profiles each extend over at least 30% of a height of the container.

14 Claims, 4 Drawing Sheets

(51) Int. Cl.
*B65D 23/08* (2006.01)
*B65D 1/40* (2006.01)
*B65D 1/44* (2006.01)

(52) U.S. Cl.
CPC .. *B65D 23/0878* (2013.01); *B65D 2501/0018* (2013.01); *B65D 2501/0027* (2013.01); *B65D 2501/0081* (2013.01)

(58) Field of Classification Search
CPC ..... B65D 1/0223; B65D 2501/0027; B65D 2501/0081; B65D 2501/0018; B65D 23/0871; B65D 23/0878; B65D 1/40
USPC ..... 215/382, 383, 384
See application file for complete search history.

(56) References Cited

U.S. PATENT DOCUMENTS 3,536,223 A * 10/1970 Hammes ..... B65D 1/0223 215/383
4,308,955 A 1/1982 Schieser et al.
4,620,639 A 11/1986 Yoshino
5,117,993 A * 6/1992 Vesborg ..... B41F 15/0895 215/365
5,735,421 A 4/1998 Deemer et al.
5,827,456 A 10/1998 Bergner et al.
6,591,986 B2 7/2003 Soehnlen et al.
7,032,770 B2 4/2006 Finlay et al.
7,178,684 B1 * 2/2007 Budden ..... B65D 1/0223 215/381
8,561,821 B2 * 10/2013 Harris ..... B65D 1/0223 215/381
8,746,453 B1 * 6/2014 Hall ..... B65D 21/0202 206/504
2002/0008077 A1 * 1/2002 Lane ..... B65D 1/0223 215/381
2004/0129598 A1 7/2004 Zhang et al.
2004/0164047 A1 8/2004 White
2008/0245762 A1 * 10/2008 Matsuoka ..... B65D 1/0223 215/383
2010/0301003 A1 * 12/2010 Lewis ..... B65D 1/0223 215/384
2011/0079574 A1 * 4/2011 Wurster ..... B65D 79/005 215/383
2012/0205342 A1 * 8/2012 Philip ..... B65D 1/0223 215/382
2012/0228312 A1 9/2012 Sutherland
2015/0158620 A1 * 6/2015 Sekiguchi ..... B65D 1/32 215/382

FOREIGN PATENT DOCUMENTS

WO WO9710998 3/1997
WO WO 2014/101957 A1 7/2014

* cited by examiner

CONTAINER WITH ARCUATE SIDEWALL PANELS

CROSS-REFERENCE TO RELATED PATENT APPLICATIONS

This application claims the benefit of priority under 35 U.S.C. §119(e) to U.S. Provisional Patent Application Ser. No. 62/089,918 filed Dec. 10, 2014, the entirety of which is incorporated herein by reference.

BACKGROUND

Containers used to transport and store solid and liquid materials are commonly manufactured from plastic for its durability and low cost. The thickness of container sidewalls may be decreased in an effort to reduce the cost of material and decrease the impact of plastic on the environment. However, decreasing sidewall thickness can also decrease the structural stability of the container and result in container collapse during shipment. This is particularly true when vertically stacking containers to increase the number of container units within a perimeter such as a floor area or pallet area.

A container design that results in a more structurally stable container that resists compressive forces from adjacent containers, or expansive forces from a liquid or solid stored within the container, would be desirable.

BRIEF SUMMARY

The following presents a simplified summary in order to provide a basic understanding of some aspects of one or more embodiments of the present teachings. This summary is not an extensive overview, nor is it intended to identify key or critical elements of the present teachings, nor to delineate the scope of the disclosure. Rather, its primary purpose is merely to present one or more concepts in simplified form as a prelude to the detailed description presented later.

In an embodiment, a container can include a first end having a base, a second end having an opening therein, wherein the first end is opposite the second end and the base is opposite the opening, a sidewall that connects with the base and extends between the first end and the second end, an axis that extends perpendicular to the base from the first end to the second end, and at least one sidewall panel within the sidewall. Additionally, the at least one sidewall panel can include an arcing profile along a direction parallel with the axis. The at least one arcing profile can extends over at least 30% of a height of the container.

In another embodiment, a method for forming a container can include forming a first end having a base, forming a second end having an opening therein, wherein the first end is opposite the second end and the base is opposite the opening, forming a sidewall that connects with the base and extends between the first end and the second end, wherein the container includes an axis that extends perpendicular to the base from the first end to the second end, and forming at least one sidewall panel within the sidewall. The formation of at least one sidewall panel can include forming an arcing profile along a direction parallel with the axis. Additionally, the at least one arcing profile is formed to extend over at least 30% of a height of the container.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

It should be noted that some details of the FIGS. have been simplified and are drawn to facilitate understanding of the present teachings rather than to maintain strict structural accuracy, detail, and scale.

DETAILED DESCRIPTION

The following description of the preferred embodiments is merely exemplary in nature and is in no way intended to limit the invention, its application, or uses.

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

As described herein, unless otherwise specified, a "container" includes a container for a solid, liquid, or gaseous material. The container may be manufactured from a plastic such as polyethylene terephthalate (PETE), high density polyethylene (HDPE), low density polyethylene (LDPE), polyvinyl chloride (PVC), polypropylene (PP), polycarbonate (PC), polylactide, etc., or another suitable material.

An embodiment of the present teachings can provide a container such as a bottle, jug, flask, etc., that has increased resistance to compressive forces. The compressive forces may be, for example, top loading forces applied when stacking at least a second container, more than one container, or one or more other articles, onto a first container. A compressive force may also result from another source, such as a contraction of a material within a sealed container during use. A compressive force may also result from side loading applied by an article adjacent to the container. Further, while the container is generally described with reference to compressive forces, a container according to one or more embodiments as described may have increased resistance to expansive forces from, for example, an expanding material within the container during increasing or decreasing temperatures.

Figure 1:
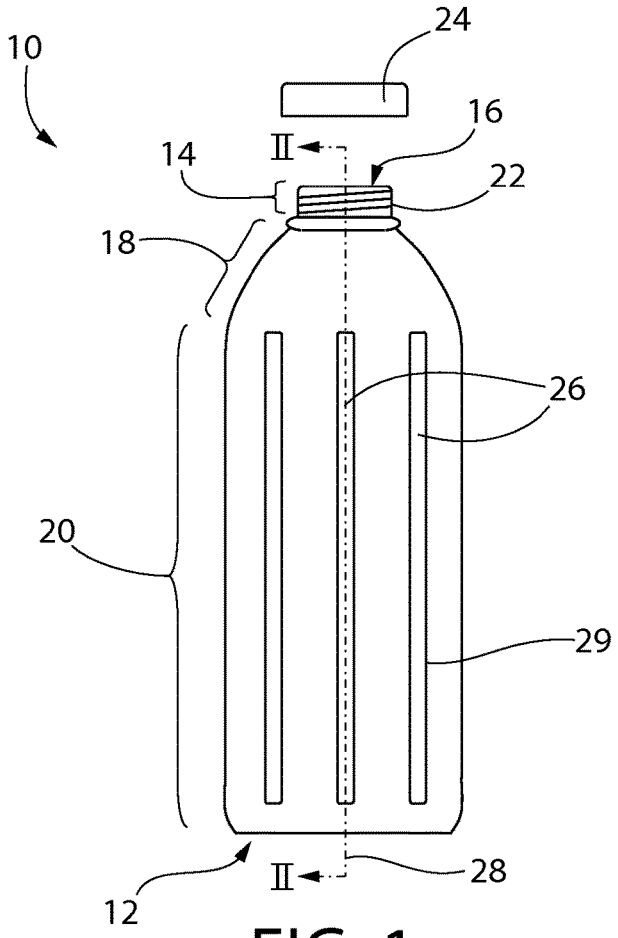
FIG. 1 is a side view of a container including one or more raised or recessed sidewall panels or ribs in one or more sidewalls in accordance with an embodiment of the present teachings.

FIG. 1 depicts a side view of a container 10 including an embodiment of the present teachings. A container 10 according to an embodiment of the present teachings may have any shape, for example cylindrical, cuboidal, cubic, pyramidal, ellipsoidal, x-angled, etc. The depicted container 10 includes a base 12, a top 14 opposite the base 12, the top having an opening 16 therein, a shoulder 18, and a sidewall 20 that extends between the shoulder 18 and the base 12. The top 14 may include threads 22 for attaching a cap 24. It will be appreciated that other container designs may be used, such as a container having a cuboidal shape with a flat top 14 and no shoulder 18, or a container having sloped sidewalls 20 rather than the vertical sidewalls as depicted. Further, an actual container may include additional structures that are not depicted for simplicity, while other depicted structures may be removed or modified.

Figure 4C:
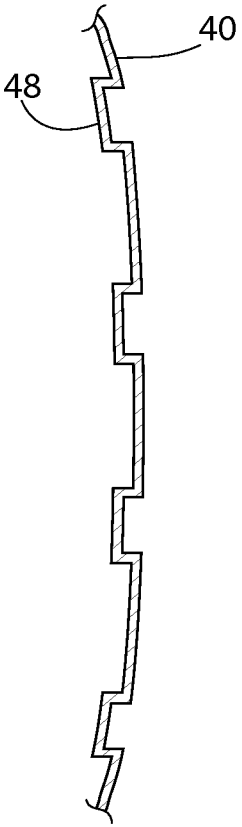
FIGS. 4B and 4C are cross sections, of a sidewall panel that includes a raised and/or recessed pattern within one or more sidewall panels.
Figure 4B:
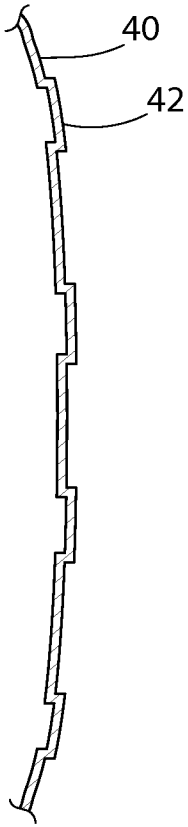
Figure 4A:
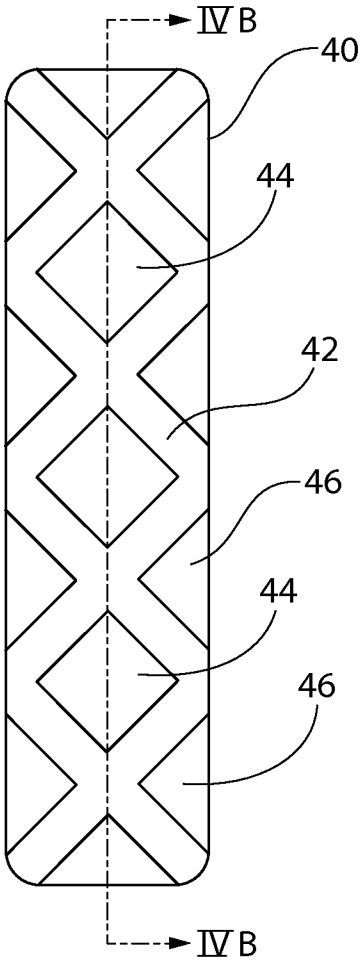
FIG. 4A is a plan view.

A container 10 in accordance with the present teachings further includes one or more discrete (e.g., separate, unconnected) vertically oriented sidewall panels or ribs 26 as depicted in FIG. 1, where each sidewall panel 26 may be recessed or raised. For purposes of the present disclosure, a recessed sidewall panel is a sidewall panel that extends away from the sidewall 20 toward an interior of the container 10. A raised sidewall panel is a sidewall panel that extends away from the sidewall 20 toward an exterior of the container 10. In other words, a recessed sidewall panel extends toward an axis 28 of the container relative to the sidewall 20, where the axis extends from the opening 16 to the base 12 in a direction generally perpendicular to a major surface of the base 12, while a raised sidewall panel extends away from the axis 28 relative to the sidewall 20. In either case, the sidewall panel 26 includes a perimeter 29, where the perimeter 29 may be rectangular in shape as depicted. The perimeter 29 may have, for example, 90° corners as depicted in FIG. 1, or rounded corners as depicted in FIG. 4A that provide a rounded rectangle. Generally, the perimeter 29 of the sidewall panel may have any other shape, such as diamond, triangular, undulating, oval, or wave shape, etc. While the present teachings are generally discussed below with reference to a recessed sidewall panel or a raised sidewall panel, it will be understood that the container 10 may include one or more raised sidewall panels exclusive of, or in addition to, one or more recessed sidewall panels.

As depicted in FIG. 1, the top 14 transitions into the shoulder 18, and the shoulder 18 transitions into the sidewall 20, where the sidewall 20 connects to the base 12. The container 10 has an overall height as depicted, where the height may be defined as a distance from a horizontal plane at an exterior of the container 10 parallel with the base 12 to a horizontal plane at an exterior of the top 14 of the container 10. As depicted in FIG. 1, the top 14 terminates in the opening 16, although other embodiments are contemplated. In an embodiment, the top 14 and shoulder 18 may together provide between about 1% and about 50% of the overall height of the container 10. The sidewall 20 may provide between about 50% and about 99% of the overall height of the container 10. The sidewall panels 26 can extend across more than about 30% of the overall height of the container 10, or more than about 50% of the overall height of the container 10, or more than about 75% of the overall height of the container 10, or more than about 90% of the overall height of the container 10. The sidewall panels 26 can further extend across more than 10%, or more than 30%, of a height of the sidewalls 20, or between about 30% and about 100% of the height of the sidewalls. Sidewall panels 26 that extend across less than these percentages of the heights of the container 10 and sidewalls 20 may result in decreased resistance to compressive forces and/or expansive forces.

Figure 2:
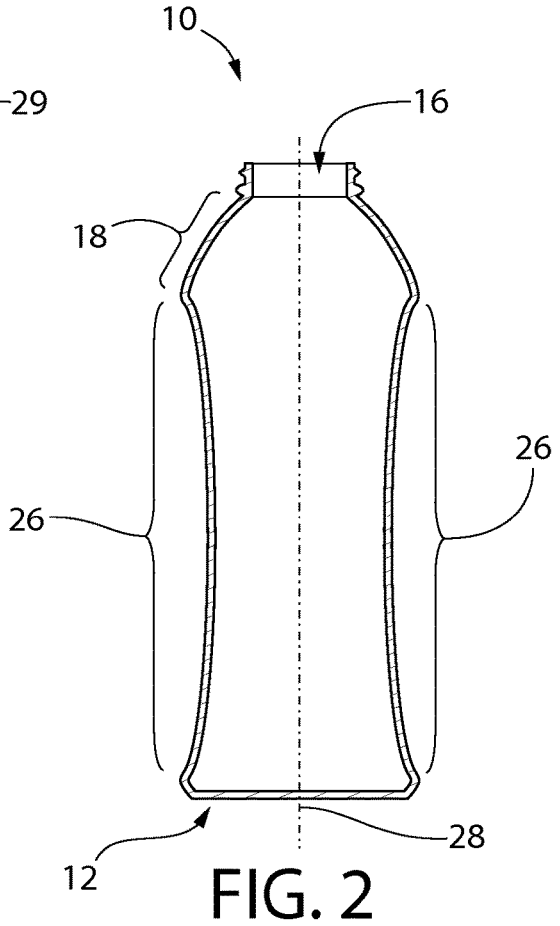
FIG. 2 is a cross section of the FIG. 1 container through a recessed sidewall panel.

FIG. 2 is a cross section of the FIG. 1 structure, where the cross section intersects axis 28 and encompasses two recessed sidewall panels 26 on opposite sides of the container 10. As depicted in FIG. 2, each sidewall panel 26 includes an arcing (e.g., arcuate) profile. As depicted in FIG. 2, each sidewall panel 26 includes a continuous arcing profile. A distance from the arcing profile (i.e., the sidewall panel portion nearest the opening 16 and farthest from the base 12) of the sidewall panel 26 to the axis 28 decreases as the sidewall panel 26 continues down from an upper extent of the sidewall panel 26 until it reaches a sidewall panel midline (i.e., a plane through the container 10 perpendicular to the axis 28 through the point where the sidewall panel is closest to the axis 28), and then the distance from the arcing profile of the sidewall panel 26 to the axis 28 increases as the arcing profile continues down from the midline to a lower extent of the sidewall panel 26 (i.e., the sidewall panel portion nearest the base 12 and farthest from the opening 16). In other words, the arcing profile of the sidewall panel 26 extends continuously toward the axis 28 from the upper extent to the midline, and extends continuously away from the axis 28 from the midline to the lower extent. In some embodiments, the arcing profile of the sidewall panel 26 can be continuous from the upper extent to the lower extent of the sidewall panel 26 as depicted, for example, in FIG. 2. In some embodiments, the midline may be equidistant from the upper extent of the sidewall panel 26 and the lower extent of the sidewall panel 26. In other embodiments, the midline is not equidistant from the upper extent of the sidewall panel 26 and the lower extent of the sidewall panel 26. As further depicted, the arcing profile of each sidewall panel 26 extends over at least 30% of a height of the sidewall 20, and may extend over at least 30% of the height of the container 10. In other embodiments, the continuous arcing profile of each sidewall panel 26 may extend over a majority (i.e., over 50%) of a height of the sidewall 20, and over a majority (i.e., over 50%) of the height of the container 10. The continuous arcing profile may be maintained along the entire height of the sidewall panels, and along both the inside and outside surfaces of the container in a direction parallel with the axis 28, where the axis is perpendicular with the base 12. While two recessed sidewall panels 26 are depicted in the FIG. 2 cross section, a container may include any number of sidewall panels, for example, from one to eight, or more. The entirety of each continuous arcing profile of each sidewall panel 26 is contained within the perimeter 29 of each sidewall panel 26. In FIG. 2, the continuous arcing profile of the depicted sidewall panels 26 are concave relative to the sidewall 20 of the container 10 when viewed from the outside of the container 10. Further, while FIG. 1 depicts a container with vertical sidewalls 20, a container may have sloped or arcuate sidewalls 20.

The sidewall panel 26 can extend into the container 10 for a distance that will depend, for example, on the size and shape of the container 10. The distance can therefore be normalized for any given container. In an embodiment, a recessed sidewall panel 26 can extend into the container 10 for a first distance "a," where "a" is measured from a reference point on the sidewall 20 that is on or immediately adjacent to the perimeter 29 at the midline of the sidewall panel 26, to the point where the sidewall panel 29 is closet to the axis 28. In this embodiment, the axis 28 is perpendicular to the base 12 and intersects the base 12 at the midpoint of the base 12. The first distance "a" can be compared to a second distance "b," where "b" is the distance from the reference point to the axis 28. For example, a sidewall panel 26 for a specific container 10 may extend into the container 10 for a distance of 5.0 mm (a=5.0), while the distance from the reference point on the sidewall 20 to the axis 28 is 10 mm (b=10). In this specific instance, the normalized distance would equal a/b, or 0.5 (i.e., 50%). In an embodiment, a/b may be from about 0.5% to about 50%, or from about 1% to about 15%, or from about 10% to about 50%, or from about 25% to about 50%.

Figure 3:
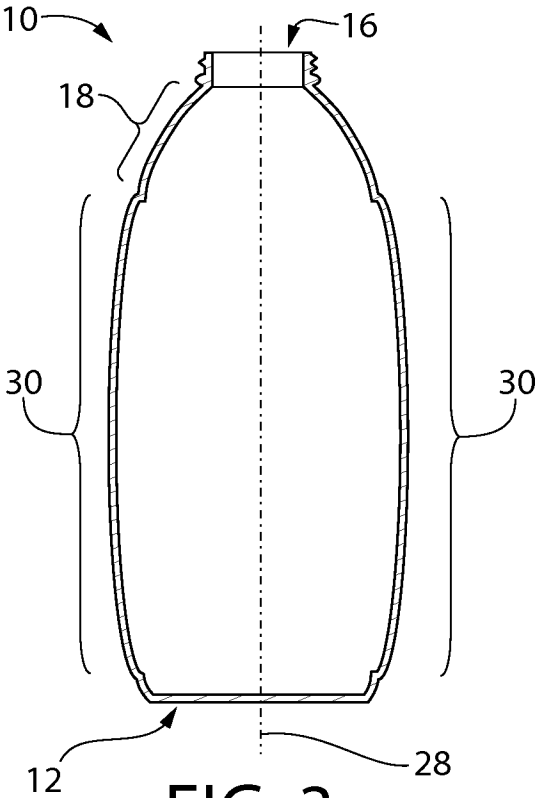
FIG. 3 is a cross section of the FIG. 1 container through a raised sidewall panel.

FIG. 3 depicts a cross section analogous to the FIG. 2 cross section, where the container 10 includes two or more raised sidewall panels 30. As depicted in FIG. 3, each sidewall panel 30 includes a continuous arcing profile. A distance from the arcing profile of the sidewall panel 30 to the axis 28 increases as the sidewall panel 30 continues down from an upper extent of the sidewall panel 30 until it reaches a sidewall panel midline, and then the distance from the arcing profile to the axis 28 decreases as the sidewall panel 30 continues down from the midline to a lower extent of the sidewall panel 30. In other words, the arcing profile of the sidewall panel 30 extends continuously away from the axis 28 from the upper extent to the midline, and extends continuously toward from the axis 28 from the midline to the lower extent. In various embodiments, the midline may not be in the true middle of the sidewall panel 30. As further depicted, the continuous arcing profile of each sidewall panel 30 extends over a majority of a height of the sidewall 20, and over a majority of the height of the container 10. While two raised sidewall panels 30 are depicted in the FIG. 2 cross section, a container may include any number of sidewall panels. The entirety of each continuous arcing profile of each sidewall panel 30 is contained within the perimeter 29 of each sidewall panel 30. In FIG. 3, the continuous arcing profile of the depicted sidewall panels 30 are convex relative to the sidewall 20 of the container 10 when viewed from outside the container 10.

Thus as depicted in FIGS. 2 and 3, the sidewall panels 26 (FIG. 2) and 30 (FIG. 3) can provide a container 10 with an increased resistance to compressive forces, such as top and side loading compressive forces placed onto the container during stacking of one or more other containers thereon.

In an embodiment, the one or more sidewall panels can include a non-flat pattern within the sidewall panel perimeter 29 to further increase resistance to compressive forces such as top loading forces. FIG. 4A is a plan view, and FIG. 4B is a cross section, depicting a sidewall panel 40 including a continuous arcing profile, where the profile includes a raised or recessed pattern 42 to improve the load resistance of the container 10. FIGS. 4A and 4B depict a sidewall panel pattern 42 with sidewall panel center portions 44 and sidewall panel edge portions 46 following a continuous arcing profile. The sidewall panel pattern 42 may be raised or recessed, depending on whether the interior of the container is to the left or right of FIG. 4B respectively. In an embodiment, a combination of raised and recessed areas may be incorporated within the sidewall panel 40, such as recessed center portions 44, a raised sidewall panel pattern 42, with sidewall panel edge portions 46 at an intermediate level between the recessed center portion 44 and the raised sidewall panel pattern 42, where portions 42, 44, 46 follow a continuous arcing profile as described above. FIG. 4C depicts a sidewall panel pattern 48 that is in a direction opposite to that of FIG. 4B.

The sidewall panel patterns 42, 48 and sidewall panel 40 may maintain the arc of the continuous arcing profile over the entire height of the sidewall panels and thus are not flat. Therefore, the sidewall panels as depicted in FIG. 4 include a continuous arcing profile. In the continuous arcing profile of FIG. 4B, for example, each segment 40, 42 maintains the arc of the sidewall panel on both its inside and outside surfaces, and is not flat. This is in contrast to some prior containers having indentations with flat profiles, and containers having discontinuous indentations that provide an area for placement of, for example, logos or other identifiers. In some embodiment, the arcing profile may be discontinuous. Additionally, FIG. 4A depicts sidewall panel center portions 44 as having corners with 90° angles, but it will be appreciated that the corners may be rounded or have angles with measurements different than 90°, for example two angles of 135° and two angles of 45°. Additionally, the sidewall panel center portions 44 may be other shapes, such as oval, circular, pentagonal, etc.

Figure 5:
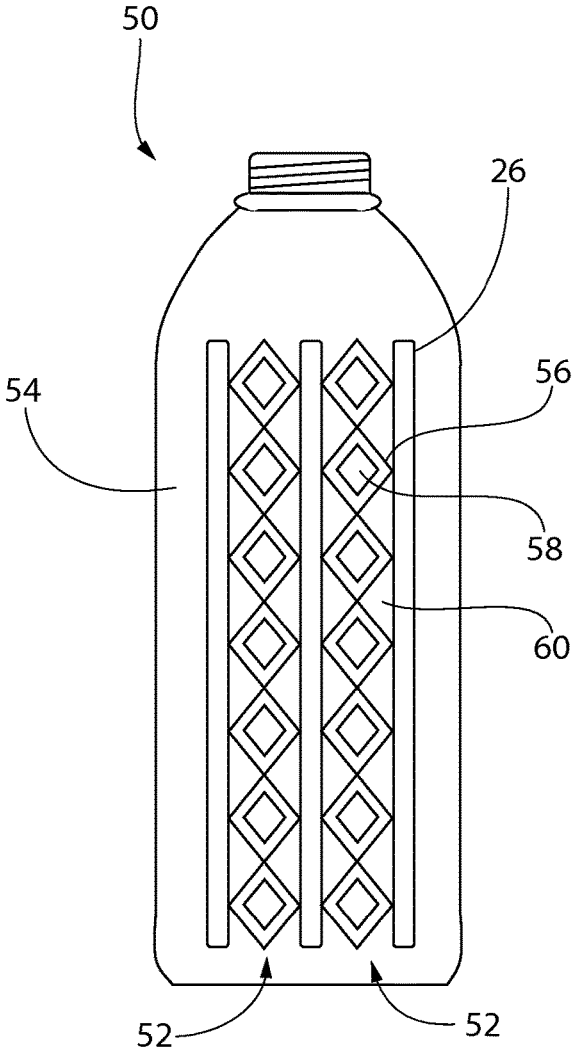
FIG. 5 is a side view of a container that includes a raised and/or recessed sidewall pattern and raised and/or recessed sidewall panels in accordance with an embodiment of the present teachings.

FIG. 5 depicts a container 50 including one or more discrete continuous arcing sidewall panels 26 as described above. The sidewall panels 26 may be raised or recessed, and may include patterns 42 as described above with reference to FIG. 4. The FIG. 5 embodiment further depicts at least one raised and/or recessed sidewall pattern 52 formed within a container sidewall 54 and interposed between the sidewall panels 26. The sidewall patterns 52 are formed to further increase resistance of the container to compressive forces, such as top or side loading forces from, for example, one or more other stacked or adjacent container. The sidewall patterns 52 are thus designed using structural, engineering, and/or architectural principles to increase resistance to compressive forces such as top or side loading forces rather than for aesthetics or other decorative considerations. Examples of shapes that increase resistance to compressive forces include triangles, diamonds, circles, ovals, V-shapes, and I-shapes, among others, and combinations thereof. In the FIG. 5 structure, the sidewall patterns 52 include a first portion 56 and a second portion 58, where the first portion 56 and the second portion 58 are concentric diamonds or squares (i.e., diamonds or squares having a common center as depicted). Other recessed or raised patterns such as triangular patterns, circular patterns, or oval patterns that increase the resistance of the container to compressive or expansive forces are contemplated. In an embodiment, a level of the first portion 56 may be raised or recessed with respect to a level of the sidewall 54, and a level of the second portion 58 may be the same level as the sidewall 54. In another embodiment, the level of the second portion 58 may be raised or lowered, opposite to that of the first portion 56. For example, if the first portions 56 are raised, the second portions 58 may be recessed, relative to the level of the sidewall 54. Third portion 60 of the sidewall patterns 52 may be the same level as the second portions 58, or may be the same level as the sidewall 54. The sidewall pattern 52 may be repeated between the sidewall panels 26 around the entirety of the container 50, or around a portion of the container. Further, while FIG. 5 depicts a single repeated sidewall pattern, multiple different patterns may be used on a single container to improve compression resistance, such as top load resistance or side load resistance.

Additionally, the sidewall panels and sidewall patterns described herein may improve the gripability of the container by providing a plurality of recessed or raised sidewall panels that aid gripping of the container. Additionally, the inclusion of sidewall pattern 52 may further improve gripability of the container 50.

Each sidewall panel as described herein has a height that is more than 30% of a height of the container sidewall, or more than 50% of the height of the container sidewall, or more than 75% of the height of the container sidewall, or more than 90% of the height of the container sidewall. Each sidewall panel as described herein may further have a height that is more than 30% of a height of the container, or more than 50% of the height of the container, or more than 75% of the height of the container, or more than 90% of the height of the container. Different sidewall panels on the container may have different heights. For example, in a container having four separate sides separated from adjacent sides by a square or rounded edge, sidewall panels near the edges of the container where two sides intersect may have a shorter height than sidewall panels near the center of the sides of the container, for example because the structure of the edges themselves have an increased resistance to compression loading.

Figure 6:
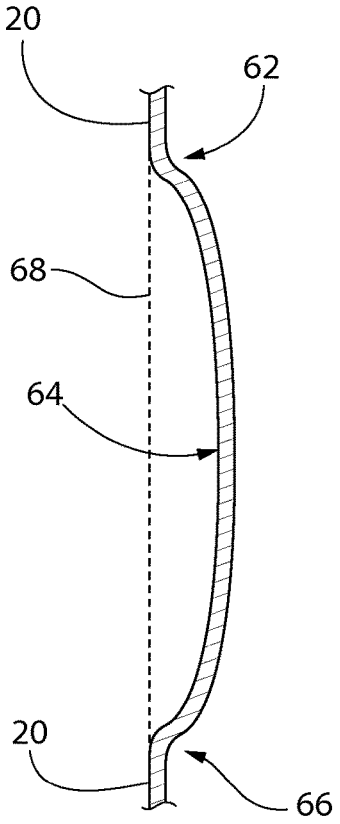
FIG. 6 is a cross section of a raised or recessed sidewall panel in accordance with an embodiment of the present teachings.

In an embodiment, FIG. 6 generally depicts a cross section taken either horizontally (i.e., in a plane perpendicular to the axis 28) or vertically (i.e., in a plane parallel to the axis 28) across a sidewall panel 26 in accordance with an embodiment of the present teachings. FIG. 6 depicts a container sidewall 20 that transitions into a first arc 62, which transitions into a second arc 64, then transitions into a third arc 66, and back into the container sidewall 20. As depicted, the rounded arcs 62, 66 that transition from the sidewall 20 are in contrast to container features that include a plane that intersects a plane of a sidewall at a sharp angle. The rounded arcs 62, 66 may provide an improved resistance to loading forces, for example, top loading and/or side loading forces.

If the interior of the container is on the right of the FIG. 6 depiction, the arcs 62, 66 may provide convex or approximately convex arcs while arc 64 may provide a concave arc. If the interior of the container is on the left of the FIG. 6 depiction, the arcs 62, 66 may provide concave arcs or approximately concave arcs while arc 64 may provide a convex arc. The alternating orientation of the arcs within a sidewall panel may provide a rigid container sidewall that is more resistant to compressive forces than a straight sidewall 20. In some embodiments, the perimeter 29 may encompass the second arc 64, but not the first arc 62 or the third arc 66, and in such embodiments the first arc 62 and the third arc 66 may be considered part of the sidewall 20. Further, in some embodiments, there may be transitional arcs, similar to the first arc 62 and the third arc 66, at the upper extent of the sidewall panel 26, 30, 40 and at the lower extent of the sidewall panel 26, 30, 40, and the perimeter 29 may not encompass any such transitional arcs.

Figure 7:
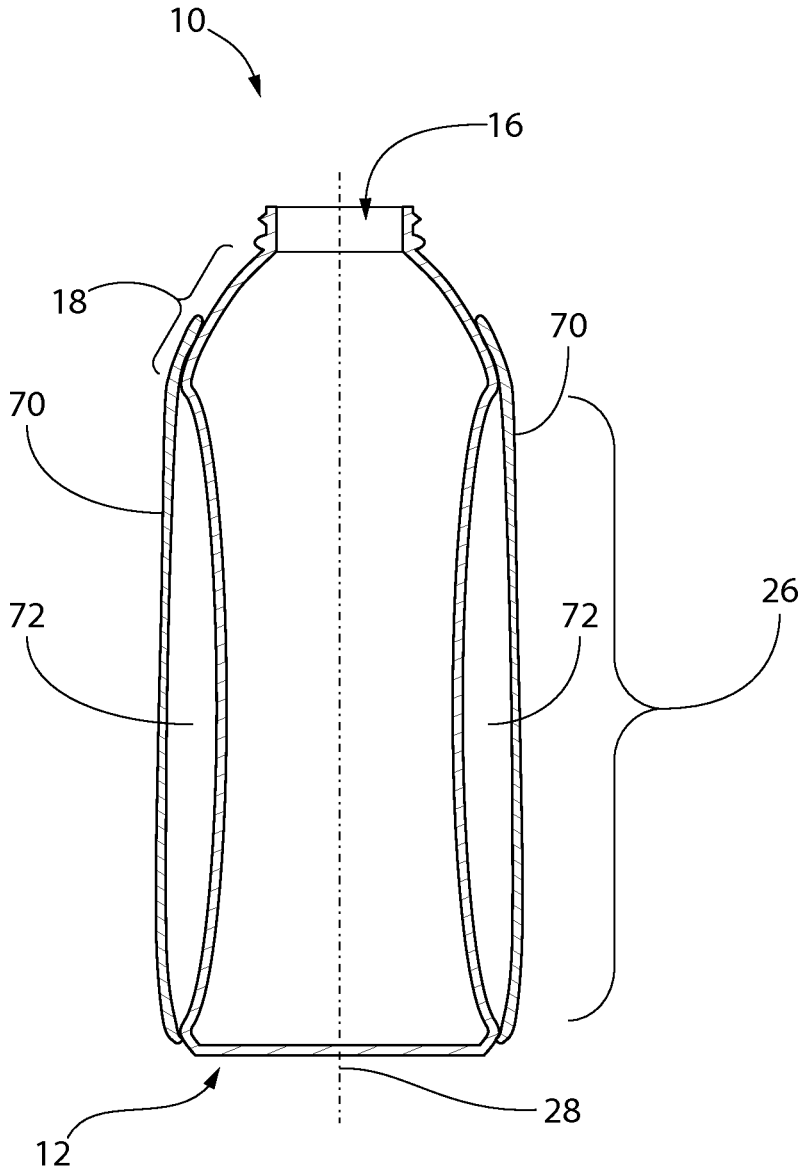
FIG. 7 is a cross section of a recessed vertical sidewall panel and a sleeve in accordance with an embodiment of the present teachings.

The vertically oriented sidewall panels as described herein may further provide other functionality. For example, FIG. 7 depicts a sleeve or skin 70 over a sidewall 20 of a container 10 such as a plastic bottle. The sleeve 70 may wrap horizontally around an entire circumference of a container 10 and may vertically cover part of the height of the container 10 as depicted. The container 10 includes one or more sidewall panels 26 as described above, for example with reference to FIG. 2. The sleeve 70 may include, for example, a skin such as a polymer skin that is formed using a shrink-wrap process, or a skin such as a neoprene or other rubberized skin that is slid into place over the exterior of the container 10. Other sleeves are also contemplated. In some embodiments using some types of sleeves 70, the vertically oriented sidewall panels 26 may allow for the application of the sleeve 70 without the sidewall panels 26 being visible and thus decrease sidewall paneling to provide a smooth appearance on the exterior surface of the container. In other container embodiments, the vertically oriented sidewall panels may be somewhat visible after applying a sleeve, but less visible than, for example, horizontal recesses that extend around the container. The sidewall panels 26 are surrounded on all lateral sides by the sidewall that supports the sleeve 70 and reduces the visibility of the sidewall panels 26 after applying the sleeve as depicted when compared to, for example, horizontal recesses that extend around the container. The recessed sidewall panels 26 result in a space or gap 72 between the sleeve 70 and the arcing profile of the sidewall panels 26 as depicted.

In another aspect, an embodiment of the present teachings may include a container having a steep shoulder 18 (FIG. 1) that provides high resistance to top loading forces. Generally, a steeper (i.e., more vertical) shoulder 18 will provide improved resistance to top loading forces.

The container can be manufactured by one of ordinary skill in the art from the description herein using conventional manufacturing techniques. Manufacturing techniques may include, but are not limited to, extrusion blow molding, plastic injection stretch blow molding, etc. Manufacturing techniques may include the use of plastic preforms, a reheat stretch blow molder, etc.

A plastic container in accordance may have a sidewall thickness, including a panel wall thickness, of from about 0.1 millimeters (mm) to about 2 mm, or from about 0.3 mm to about 1.0 mm. Embodiments may thus provide a container having a thin plastic shell to reduce weight and material, for example, to decrease shipping costs, material costs, and environmental impact from discarded containers. While the plastic shell may be thin, the inclusion of sidewall panels as described herein improve the resistance of the container to top and side loading forces.

Thus a container in accordance with the present teachings can include one or more of the features described above that render a container more resistant to compressive or expansive forces, such as side loading forces and/or top loading forces, than conventional container designs.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g. −1, −2, −3, −10, −20, −30, etc.

While the present teachings have been illustrated with respect to one or more implementations, alterations and/or modifications can be made to the illustrated examples without departing from the spirit and scope of the appended claims. For example, it will be appreciated that while the process is described as a series of acts or events, the present teachings are not limited by the ordering of such acts or events. Some acts may occur in different orders and/or concurrently with other acts or events apart from those described herein. Also, not all process stages may be required to implement a methodology in accordance with one or more aspects or embodiments of the present teachings. It will be appreciated that structural components and/or processing stages can be added or existing structural components and/or processing stages can be removed or modified. Further, one or more of the acts depicted herein may be carried out in one or more separate acts and/or phases. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. As used herein, the term "one or more of" with respect to a listing of items such as, for example, A and B, means A alone, B alone, or both A and B. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a workpiece, regardless of the orientation of the workpiece. The term "horizontal" or "lateral" as used in this application is defined as a plane parallel to the conventional plane or working surface of a workpiece, regardless of the orientation of the workpiece. The term "vertical" refers to a direction perpendicular to the horizontal. Terms such as "on," "side" (as in "sidewall"), "higher," "lower," "over," "top," and "under" are defined with respect to the conventional plane or working surface being on the top surface of the workpiece, regardless of the orientation of the workpiece.

What is claimed is:

1. A container, comprising:

a first end having a base;

a second end having an opening therein, wherein the first end is opposite the second end and the base is opposite the opening;

an axis that extends perpendicular to the base from the first end to the second end; and at least four sidewalls, wherein each sidewall is separated from an adjacent sidewall by an edge, each sidewall connects with the base and extends between the first end and the second end, and each sidewall further comprises:

at least two discrete sidewall panels, wherein each of the at least two discrete sidewall panels comprises an arcing profile along a direction parallel with the axis; and at least one sidewall pattern positioned between each of the at least two discrete sidewall panels, wherein:

the at least one sidewall pattern comprises concentric diamonds or concentric squares having a common center; and the arcing profile of each of the at least two discrete sidewall panels extends over at least 30% of a height of the container.

2. The container of claim 1, wherein the arcing profile of each of the at least two discrete sidewall panels of each of the at least four sidewalls:

comprises an upper extent nearest the opening;

comprises a lower extent nearest the base;

comprises a midline that is between the upper extent and the lower extent;

continuously extends toward the axis as the arcing profile continues down from the upper extent until it reaches the midline;

continuously extends away from the axis as the arcing continues down from the midline until it reaches the lower extent; and is continuous between the upper extent and the lower extent.

3. The container of claim 1, wherein the arcing profile of each of the at least two discrete sidewall panels of each of the at least four sidewalls extends over at least 50% of the height of the sidewall and over at least 50% of a height of the container.

4. The container of claim 1, wherein the arcing profile of each of the at least two discrete sidewall panels of each of the at least four sidewalls:

comprises an upper extent nearest the opening;

comprises a lower extent nearest the base;

comprises a midline that is between the upper extent and the lower extent;

continuously extends away from the axis as the arcing profile continues down from the upper extent until it reaches the midline;

continuously extends toward the axis as the arcing profile continues down from the midline until it reaches the lower extent; and is continuous between the upper extent and the lower extent.

5. The container of claim 4, wherein the arcing profile of each of the at least two discrete sidewall panels of each of the at least four sidewalls extends over at least 50% of the height of the sidewall and over at least 50% of a height of the container.

6. The container of claim 1, wherein each of the at least two discrete sidewall panels comprises a sidewall panel perimeter, wherein the sidewall panel perimeter comprises a shape selected from the group consisting of rectangular, diamond, triangular, undulating, and wave.

7. The container of claim 6, wherein each of the at least two discrete sidewall panels further comprises a non-flat pattern within the sidewall panel perimeter.

8. A method for forming a container, comprising:

forming a first end having a base;

forming a second end having an opening therein, wherein the first end is opposite the second end and the base is opposite the opening;

forming at least four sidewalls, wherein each sidewall is formed such that each sidewall is separated from an adjacent sidewall by an edge;

forming each sidewall to connect with the base and to extend between the first end and the second end, wherein the container comprises an axis that extends perpendicular to the base from the first end to the second end;

forming at least two discrete sidewall panels within each sidewall, wherein the formation of the at least two discrete sidewall panels comprises forming an arcing profile along a direction parallel with the axis in each sidewall panel; and forming at least one sidewall pattern positioned between each of the at least two discrete sidewall panels, wherein:

the at least one sidewall pattern comprises concentric diamonds or concentric squares having a common center; and the arcing profile is formed to extend over at least 30% of a height of the container.

9. The method of claim 8, wherein each arcing profile:

forms an upper extent of the arcing profile nearest the opening;

forms a lower extent of the arcing profile nearest the base;

forms a midline that is between the upper extent and the lower extent;

forms the arcing profile to extend continuously toward the axis as the arcing profile continues down from the upper extent until it reaches the midline;

forms the arcing profile to extend continuously away from the axis as the arcing continues down from the midline until it reaches the lower extent; and forms the arcing profile to be continuous between the upper extent and the lower extent.

10. The method of claim 8, further comprising forming each arcing profile to extend over at least 50% of the height of the sidewall and over at least 50% of a height of the container.

11. The method of claim 8, wherein of each arcing profile:

forms an upper extent of the arcing profile nearest the opening;

forms a lower extent of the arcing profile nearest the base;

forms a midline that is between the upper extent and the lower extent;

forms the arcing profile to extend continuously away from the axis as the arcing profile continues down from the upper extent until it reaches the midline;

forms the arcing profile to extend continuously toward the axis as the arcing profile continues down from the midline until it reaches the lower extent; and forms the arcing profile to be continuous between the upper extent and the lower extent.

12. The method of claim 11, further comprising forming each arcing profile to extend over at least 50% of the height of the sidewall and over at least 50% of a height of the container.

13. The method of claim 8, further comprising forming each sidewall panel to comprise a sidewall panel perimeter, wherein the sidewall panel perimeter comprises a shape selected from the group consisting of rectangular, diamond, triangular, undulating, and wave.

14. The method of claim 13, further comprising forming each sidewall panel to comprise a non-flat pattern within the sidewall panel perimeter.

* * * * *